US006910418B1

(12) United States Patent
Yu

(10) Patent No.: US 6,910,418 B1
(45) Date of Patent: Jun. 28, 2005

(54) VARIABLE PATTERN STAMP

(76) Inventor: Wayne Yu, 7F, No. 651-1, Chungcheng Rd., Hsinchuang City, Taipei Hsien (TW)

( * ) Notice: Subject to any disclaimer, the term of this patent is extended or adjusted under 35 U.S.C. 154(b) by 0 days.

(21) Appl. No.: 10/747,360

(22) Filed: Dec. 30, 2003

(51) Int. Cl.[7] ..... B41B 1/00
(52) U.S. Cl. ..... 101/374; 101/103; 101/109; 101/399
(58) Field of Search ..... 101/103, 109, 101/112, 374, 399, 405, 406

(56) References Cited

U.S. PATENT DOCUMENTS 3,843,437 A * 10/1974 Robinson ..... 156/219
4,182,241 A * 1/1980 Holtorf ..... 101/405
4,221,164 A * 9/1980 Krulwich ..... 101/109
4,375,191 A * 3/1983 Dickey ..... 101/333
5,313,885 A * 5/1994 Winston ..... 101/405
5,655,451 A * 8/1997 Wasylczuk et al. ..... 101/368
5,996,493 A * 12/1999 Okumura et al. ..... 101/333
6,095,046 A * 8/2000 Lookholder et al. ..... 101/405
6,098,535 A * 8/2000 Lynn ..... 101/109
6,324,977 B1 * 12/2001 Hadden ..... 101/405

* cited by examiner

*Primary Examiner*—Andrew H. Hirshfeld
*Assistant Examiner*—Jill E. Culler
(74) *Attorney, Agent, or Firm*—Rosenberg, Klein & Lee

(57) ABSTRACT

A variable pattern stamp has a base and a stamp plate unit. The base has smooth face and preferably is transparent. The stamp plate unit has multiple pattern plates and a protective sheet. The pattern plates have different or the same patterns and are preferably transparent. The protective sheet keeps the pattern plate from wrinkling, sticking to itself and getting dirty and losing its tackiness. After an individual pattern plate is selected and separated from adjacent pattern plates, the selected pattern plate is bonded detachably to the base and can be easily changed. People just buy one stamp and can stamp multiple patterns on papers and at the correct location.

2 Claims, 4 Drawing Sheets

VARIABLE PATTERN STAMP

BACKGROUND OF THE INVENTION

1. Field of the Invention

The present invention relates to a stamp and more particularly to a stamp that has a stamp plate unit with multiple pattern plates that can be changed.

2. Description of Related Art

People use stamps to press or print a mark or pattern onto a surface. A conventional stamp comprises a body and a stamp plate. The stamp plate is bonded to the body and has an outer face with a pattern. Since a single stamp has a single pattern to stamp on paper, people must buy different stamps to stamp different patterns on paper. The multiple different stamps will occupy a lot of space.

Furthermore, a conventional stamp has at least one outer edge, is opaque and has space between the pattern and the outer edges. When people use the stamp to stamp the pattern, they cannot see the exact location to stamp the pattern. The pattern may not be stamped straight or in the correct location.

The present invention is provided to mitigate or obviate the foregoing shortcomings.

SUMMARY OF THE INVENTION

The main objective of the present invention is to provide a variable pattern stamp that has a stamp plate unit with different pattern plates that can be changed.

A secondary objective is to provide a variable pattern stamp that is transparent so the pattern can be conveniently stamped on the correct location.

To achieve the objectives, a variable pattern stamp in accordance with the present invention comprises a base and a stamp plate unit. The base has a smooth face and may be transparent. The stamp plate unit has multiple pattern plates and a protective sheet. The pattern plates have different or the same patterns and are preferably transparent. The protective sheet keeps the pattern plate from wrinkling, sticking to itself and getting dirty and losing its tackiness. After an individual pattern plate is selected and separated from adjacent pattern plates, the selected pattern plate is bonded detachably to the base and can be easily changed. People just buy one stamp and can stamp multiple patterns on paper at the correct location.

Further benefits and advantages of the present invention will become apparent after a careful reading of the detailed description with appropriate reference to the accompanying drawings.

DETAILED DESCRIPTION OF THE PREFERRED EMBODIMENT

Figure 1:
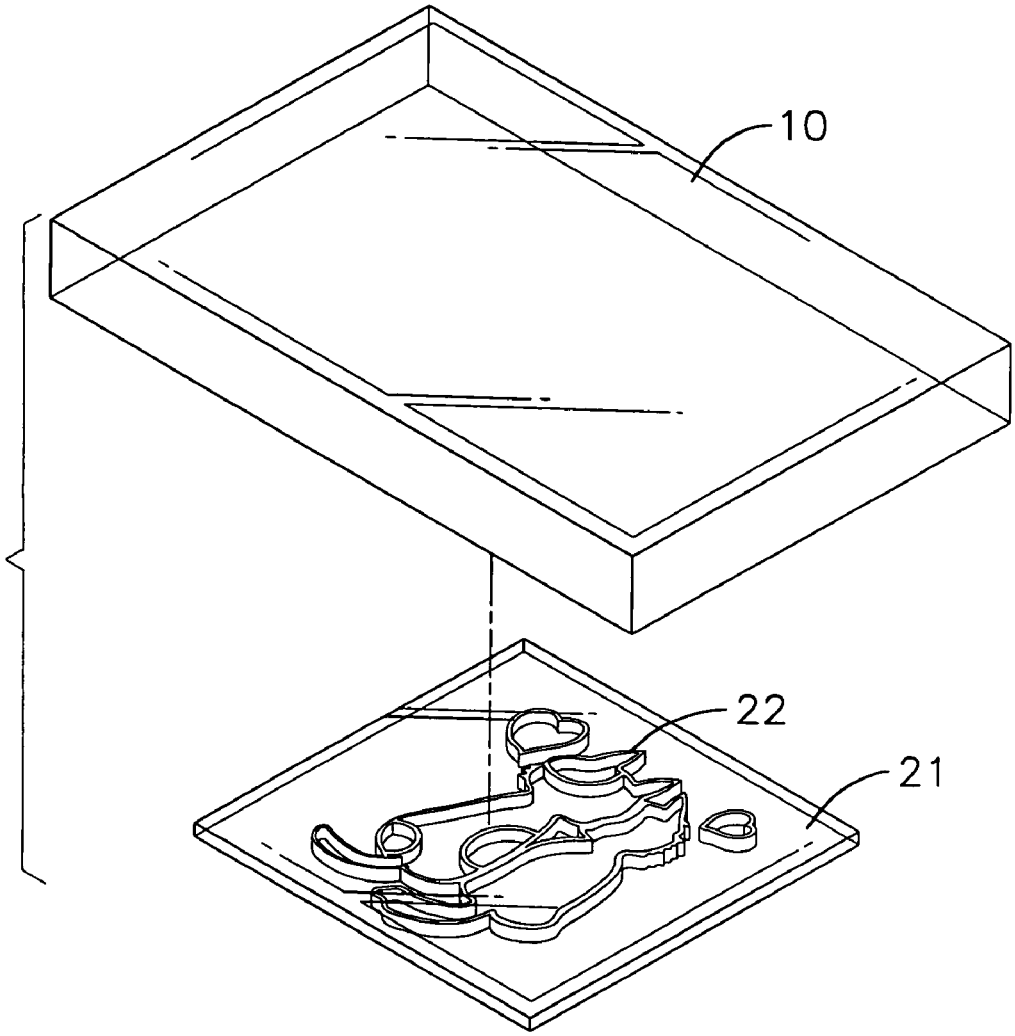
FIG. 1 is a perspective view of a variable pattern stamp in accordance with the present invention.
Figure 2:
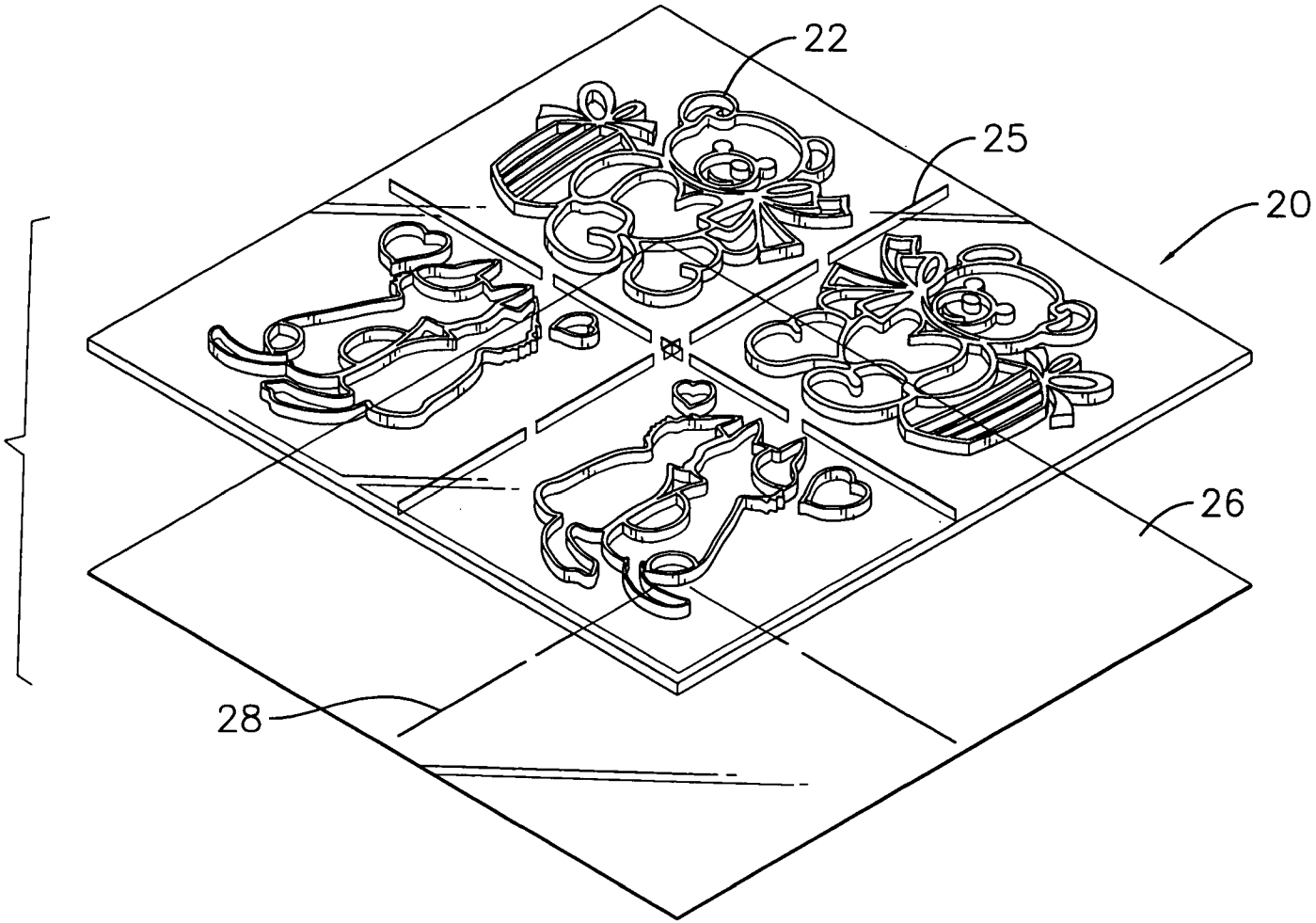
FIG. 2 is a perspective view of a stamp plate unit with different pattern plates of the variable pattern stamp in FIG. 1.
Figure 3:
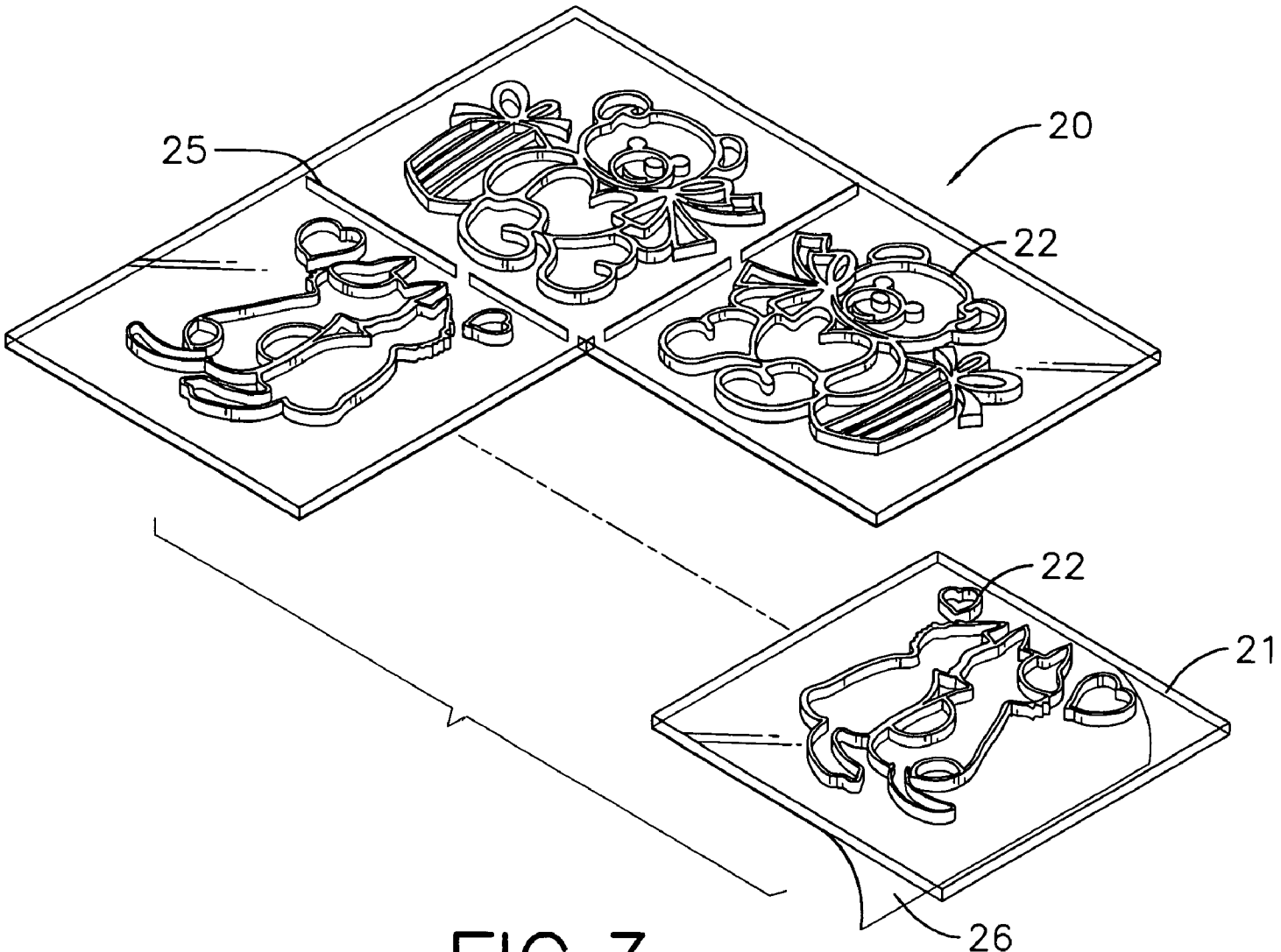
FIG. 3 is an operational perspective view of the stamp plate unit of the variable pattern stamp in FIG. 1.

With reference to FIGS. 1 to 3, a variable pattern stamp in accordance with the present invention comprises a base (10) and a stamp plate unit (20). The base (10) has a smooth face (not numbered) and may be transparent. In a preferred embodiment of the variable pattern stamp, the base (10) is transparent.

Figure 4:
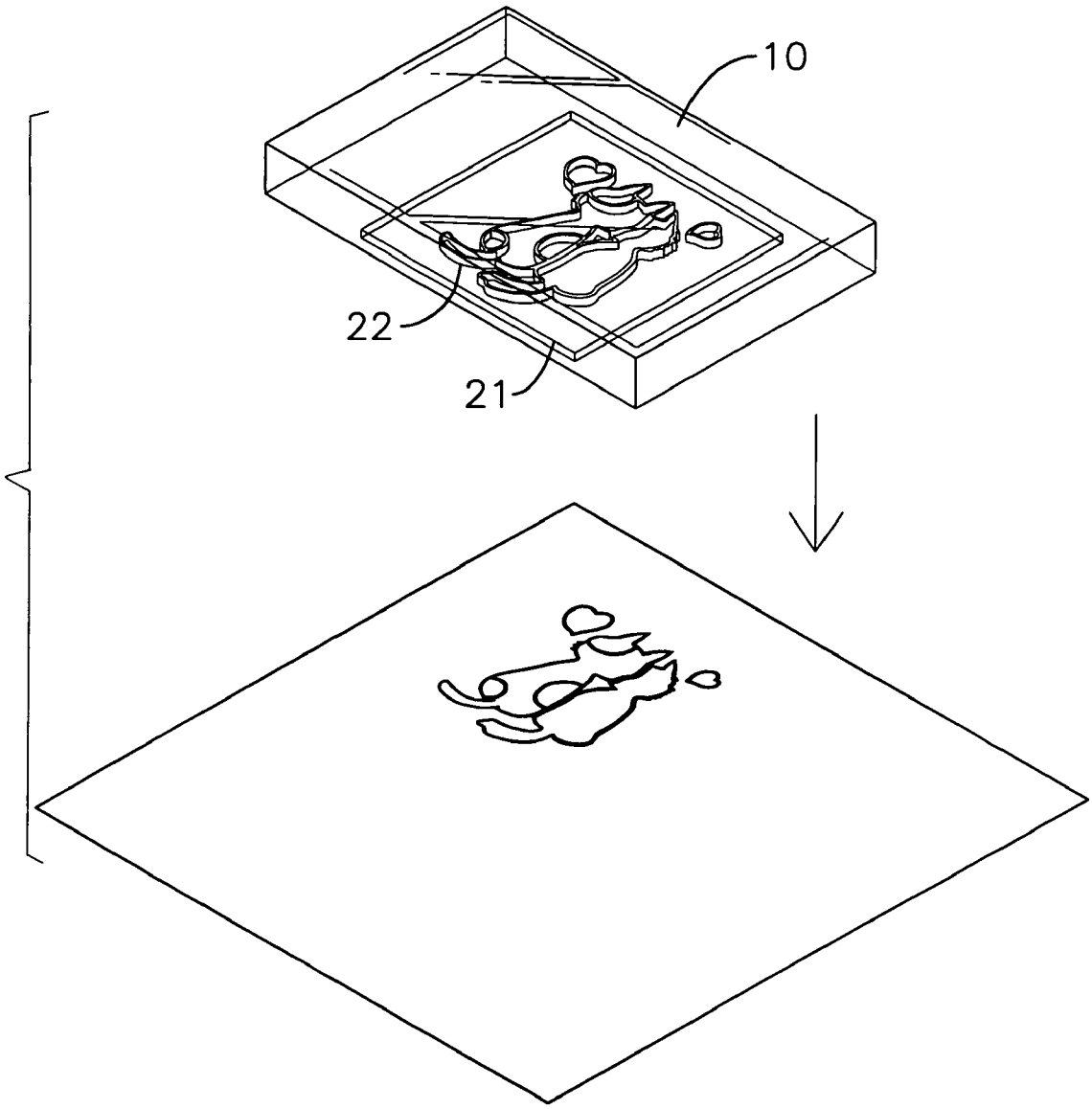
FIG. 4 is an operational perspective view of the variable pattern stamp in FIG. 1.

The stamp plate unit (20) comprises multiple pattern plates (21), an optional protective sheet (26) and optional intermittent cuts (25). The pattern plate (21) is made of a soft, tacky material and has an inner surface (not numbered), an outer surface (not numbered) and a pattern (22). The soft, tacky material may be thermoplastic rubber (TRP) and, with further reference to FIG. 4, is preferably transparent when the base (10) is transparent so people can stamp the pattern in the correct location. The inner surface is very smooth and detachably bonds to the smooth face of the base (10). The pattern (22) is formed in relief on the outer face.

When the stamp plate unit (20) has multiple pattern plates (21), intermittent cuts (25) are formed between adjacent pattern plates (21), and the soft, tacky material between adjacent intermittent cuts (25) holds the multiple pattern plates (21) together.

The protective sheet (26) is a slick material such as wax paper, acrylic film, etc., is selectively applied to the inner surface of the stamp plate unit (20) and keeps the tacky inner surface from sticking to itself and getting dirty and losing its tackiness. When the stamp plate unit (20) has multiple pattern plates (21), the protective cover (26) has multiple perforations or cuts (28) corresponding to the intermittent cuts (25) between adjacent pattern plates (21).

When a person wants to use one pattern plate (21), the desired pattern plate (21) and its protective sheet (26) are separated the adjacent pattern plates (21) along the intermittent cuts (25) in the soft, tacky material and the corresponding cuts (28) or perforations in the protective sheet (26). The protective sheet (28) is removed from the inner surface of the pattern plate (21) so the pattern plate (21) can bond to the base (10). The smooth inner surface of the pattern plate (21) is pressed onto the base (10) so no air is between the base (10) and the pattern plate (21). Without any air between the base (10) and the pattern plate (21), atmospheric pressure and the soft characteristic of the pattern plate (21) help the pattern plate (21) to bond to the base (10).

Since the stamp plate unit (20) has multiple pattern plates (21) with different or same patterns (22), individual pattern plates (21) can be separated and bonded to the base (10) to change or renew the pattern (22).

The variable pattern stamp in accordance with the present invention does not use viscose or glue to bond the pattern plate (21) to the base (10) so attaching or detaching pattern plates (21) is very convenient. Since the pattern plate (21) bonded to the base (10) can be exchanged easily, people only have to buy one stamp and can stamp multiple patterns on papers in the correct location.

Although the invention has been explained in relation to its preferredembodiment, many other possible modifications and variations can be made without departing from the spirit and scope of the invention as hereinafter claimed.

What is claimed is:

1. A variable pattern stamp comprising:

a base having a smooth face; and, a stamp plate unit made of a soft, tacky material and having:

multiple pattern plates respectively having an inner surface, an outer surface, and a pattern formed in relief on the outer surface, wherein the multiple pattern plates exchange to detachably bond to the smooth face of the base, multiple intermittent cuts being formed between adjacent ones of the pattern plates; and, a protective sheet made of a slick material applied to the inner surface of the stamp plate unit, the protective sheet having multiple cuts corresponding to the intermittent cuts between adjacent pattern plates;

wherein the base is transparent, and the pattern plate is transparent.

2. A variable pattern stamp comprising:

a transparent base having a smooth face; and, a stamp plate unit made of a soft, tacky material and having:

multiple transparent pattern plates each having an inner surface, an outer surface, and a pattern formed in relief on the outer surface, wherein the multiple pattern plates interchangeably bond to the smooth face of the base, multiple intermittent cuts being formed between adjacent ones of the pattern plates for detachment one from the other; and, a protective sheet made of a slick material applied to the inner surface of the stamp plate unit, the protective sheet having multiple perforations corresponding to the intermittent cuts between adjacent pattern plates.

* * * * *